US006860721B2

(12) United States Patent
Knott et al.

(10) Patent No.: US 6,860,721 B2
(45) Date of Patent: Mar. 1, 2005

(54) INDENTOR ARRANGEMENT

(75) Inventors: David S Knott, Loughborough (GB); Michael R Lawson, Derby (GB)

(73) Assignee: Rolls-Royce plc, London (GB)

( * ) Notice: Subject to any disclaimer, the term of this patent is extended or adjusted under 35 U.S.C. 154(b) by 134 days.

(21) Appl. No.: 10/262,971

(22) Filed: Oct. 3, 2002

(65) Prior Publication Data

US 2003/0129060 A1 Jul. 10, 2003

(51) Int. Cl.[7] ..... F01D 5/30
(52) U.S. Cl. ..... 416/219 R; 416/248
(58) Field of Search ..... 416/291 R, 248, 416/219 R; 74/475, 462; 105/96; 295/1, 31.1; 29/894.01

(56) References Cited

U.S. PATENT DOCUMENTS 4,497,612 A * 2/1985 Knorowski et al. ..... 416/198 A
6,033,185 A * 3/2000 Lammas et al. ..... 416/193 A
6,183,202 B1 * 2/2001 Ganshaw ..... 416/219 R

* cited by examiner

*Primary Examiner*—Ninh H. Nguyen
(74) *Attorney, Agent, or Firm*—W. Warren Taltavull; Manelli Denison & Selter PLLC

(57) ABSTRACT

An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface.

18 Claims, 8 Drawing Sheets

56
F
62
48
50

55
51
58
60
54
52

INDENTOR ARRANGEMENT

The present invention relates to an arrangement of an indentor for contacting a surface and in particular, although not exclusively, a dovetail arrangement for a blade and disc of a gas turbine engine.

Where an indentor is in contact with a generally flat surface of a body a peak stress arises at an edge of contact (EOC) in the body. This EOC peak stress can be three times as great as the average bearing stress and can cause surface and sub-surface micro-cracking in the body. In certain circumstances, for instance between blade and disc dovetail joint features of a gas turbine engine, the micro-cracks may be propagated by tensile stresses associated to blade centrifugal forces and which may be further exacerbated by high and/or low cycle blade frequencies. Ultimately, this may lead to failure of the dovetail joint and subsequent release of the blade or part of the blade.

This is obviously undesirable and one solution (described in "Fretting Fatigue", Waterhouse, R. B., Applied Science Publishers Ltd, Barking, England, 1981) to reducing the edge of contact stress is to machine an undercut feature in the blade approximately from the EOC and extending up the flank of the blade neck. In this case the blade is the body, its dovetail bearing surface is the contacted surface and the disc is the indentor. However, one problem with this design is that the undercut feature itself is subject to a high stress field.

Furthermore, another solution is proposed in EP1048821A2 for a blade to disc dovetail arrangement, which discloses a groove cut into the disc (indentor) just away from and above the EOC. EP1048821A2 teaches that the groove reduces the stiffness of the edge of the indentor at the contact edge to reduce the peak stress thereat. However, it is believed that the design of EP1048821A2 still produces a peak stress, greater than the average bearing stress, albeit reduced. Therefore it is possible for the design disclosed in EP1048821A2 to cause micro-cracking in the body, particularly when employed for a blade and disc dovetail of a gas turbine engine.

It is therefore an object of the present invention to provide an arrangement for an indentor which produces an edge of contact stress less than the average bearing stress and preferably an edge of contact stress near to zero or zero itself.

According to the present invention an indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface.

Preferably, the contact surface and the bearing surface generate a near uniform compressive stress field in the bearing surface and the edge of contact generates a non-uniform stress field in the bearing surface, the tapered portion is shaped so that the edge of contact non-uniform stress is a lower value than the near uniform stress.

Furthermore, it is preferred that the contact surface and the bearing surface generate a near uniform compressive stress field in the bearing surface and the edge of contact point generates a non-uniform stress field in the bearing surface, the tapered portion is shaped so that the edge of contact non-uniform stress is approximately zero.

Preferably, the tapered portion comprises a taper angle between 30 and 60 degrees and more particularly a taper angle of 45 degrees.

Preferably, the tapered portion comprises a free surface, the free surface comprising a convex shape and the free surface comprises a convex shape, the convex shape being defined by a curve having a decreasing rate of change of curvature from and between the apex of the tapered portion which is aligned normal to the bearing surface and the base which is aligned at the taper angle.

Preferably, the apex comprises a radius and furthermore a fillet radius is defined between the free surface and the indentor.

Preferably, the indentor is a disc portion and the bearing surface is a blade root. Alternatively, the indentor is a blade root of a gas turbine engine and the bearing surface is a disc portion of a gas turbine engine.

Alternatively, the indentor is a rolling element of a bearing assembly or any one of a group comprising a railway wheel and a railway track. Moreover, the indentor is a tooth.

Alternatively, the arrangement comprises a wall and a pin, the wall defining an aperture through which the pin extends, the wall further defining a tapered portion at an edge of contact with the pin.

Alternatively, the arrangement comprises a plate and a pin, the wall defining an aperture through which the pin extends, the pin further defining a tapered portion at an edge of contact with the pin.

Preferably, the tapering portion extends substantially the length of the indentor.

The present invention will now be described by way of example only with reference to the following figures in which.

Figure 1:
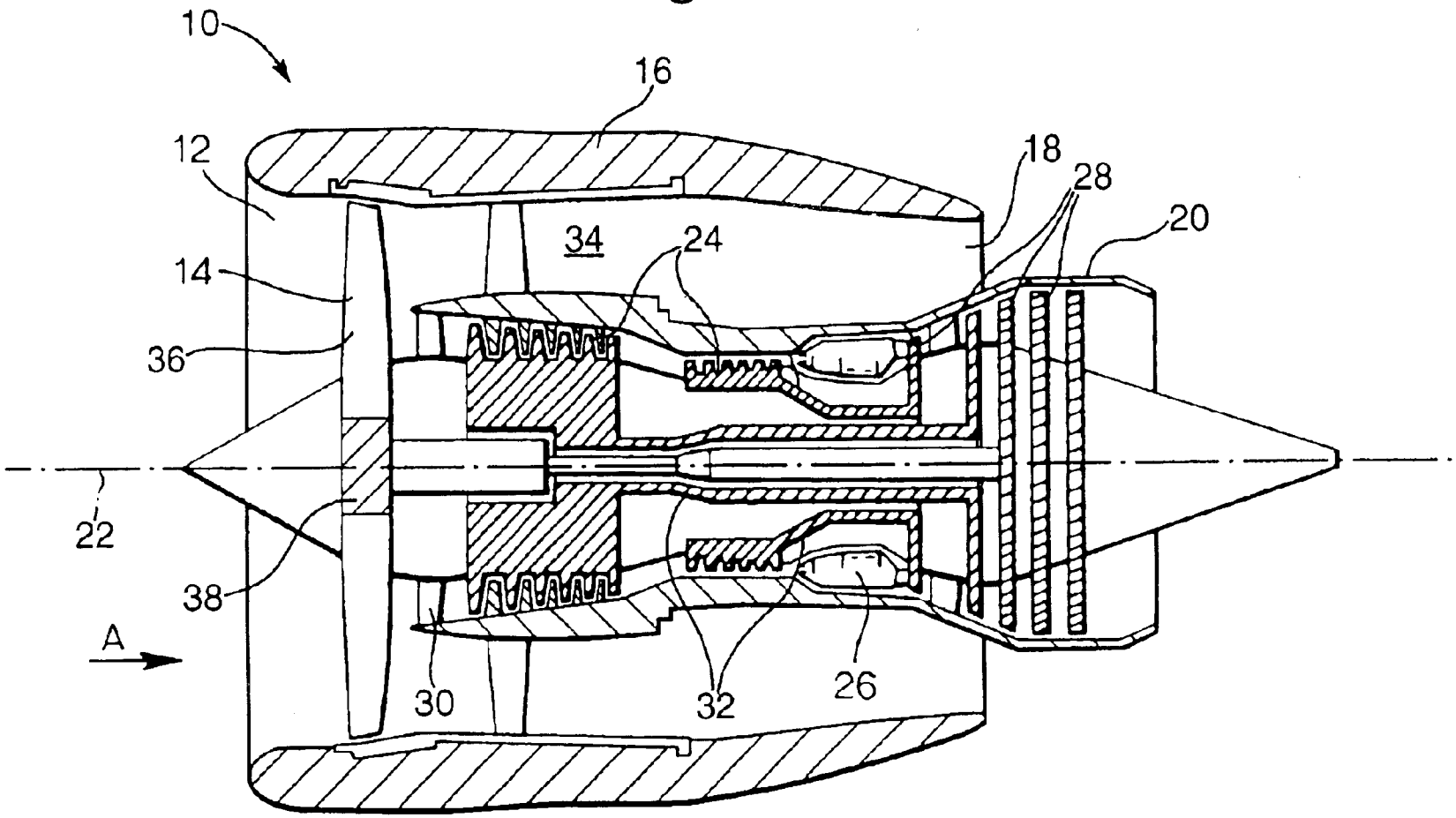
FIG. 1 is a schematic section of a ducted fan gas turbine engine incorporating a dovetail fixture in accordance with the present invention.

With reference to FIG. 1 a ducted fan gas turbine engine 10 comprises, in axial flow series an air intake 12, a propulsive fan 14, a nacelle assembly 16, a core engine 18 and a core exhaust nozzle assembly 20 all disposed about a central engine axis 22. The core engine 18 comprises, in axial flow series, a series of compressors 24, a combustor 26, and a series of turbines 28. The direction of airflow through the engine 10 in operation is shown by arrow A. Air is drawn in through the air intake 12 and is compressed and accelerated by the fan 14. The air from the fan 14 is split between a core engine flow and a bypass flow. The core engine flow passes through an annular array of stator vanes 30 and enters the core engine 18, flows through the core engine compressors 24 where it is further compressed, and into the combustor 26 where it is mixed with fuel which is supplied to, and burnt within the combustor 26. Combustion of the fuel mixed with the compressed air from the compressors 24 generates a high energy and velocity gas stream which exits the combustor 26 and flows downstream through the turbines 28. As the high energy gas stream flows through the turbines 28 it rotates turbine rotors extracting energy from the gas stream which is used to drive the fan 14 and compressors 24 via engine shafts 32 which drivingly connect the turbine 28 rotors with the compressors 24 and fan 14. Having flowed through the turbines 28 the high energy gas stream from the combustor 26 still has a significant amount of energy and velocity and it is exhausted, as a core exhaust stream, through the core engine exhaust nozzle assembly 20 to provide propulsive thrust. The remainder of the air from, and accelerated by, the fan 14 flows within a bypass duct 34 around the core engine 18. This bypass air flow, which has been accelerated by the fan 14, flows to the nacelle assembly 16 where it is exhausted, as a bypass exhaust stream to provide further, and in fact the majority of, the useful propulsive thrust. The fan 14 comprises an annular array of fan blades 36 which are retained by a fan disc 38 by dovetail fixture means (40 shown in section in FIG. 3) arranged in accordance with the present invention.

Figure 2:
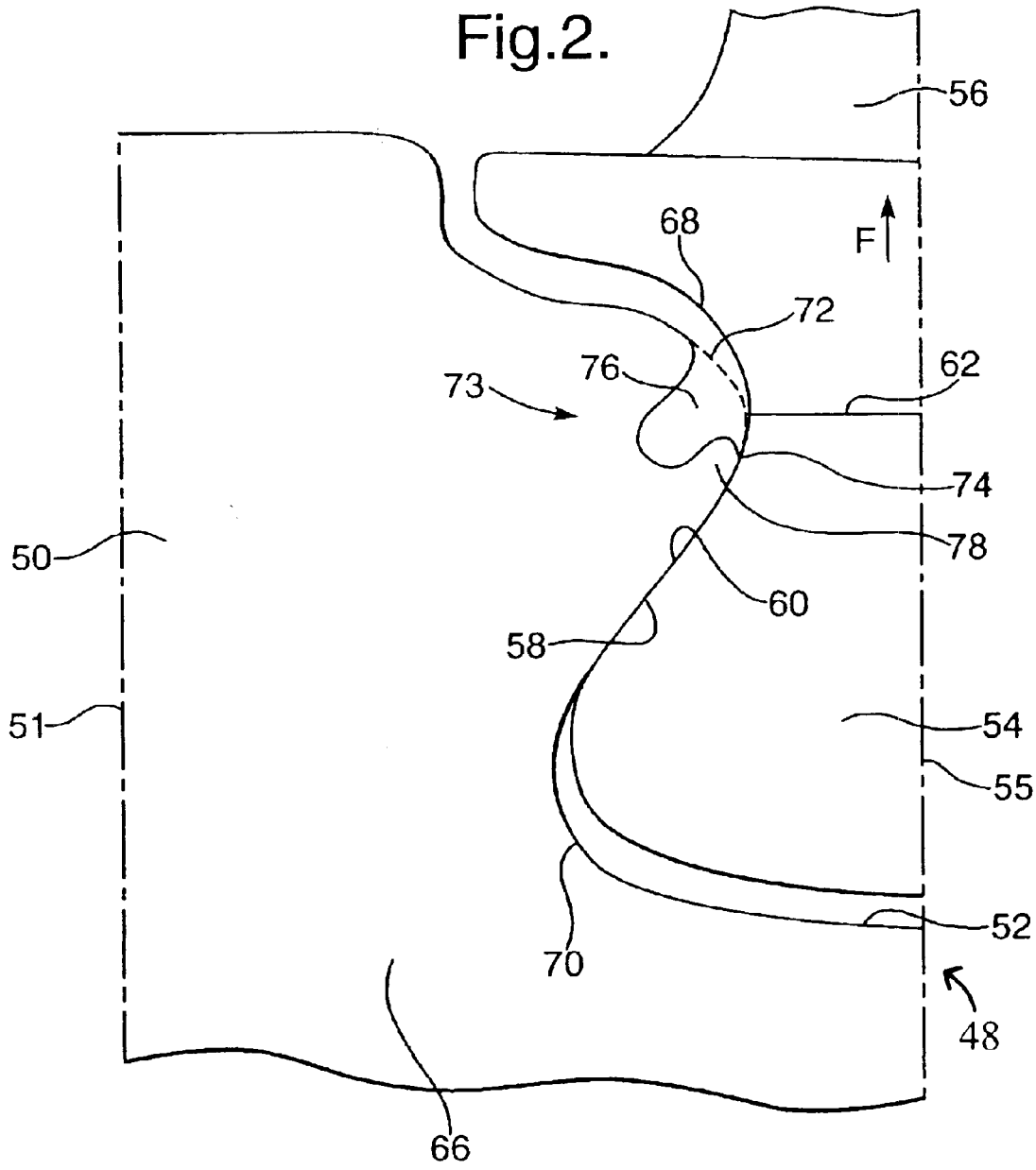
FIG. 2 is a section through a dovetail fixture of the prior art EP1048821A2.

With reference to FIG. 2, which shows a prior art dovetail arrangement 48 disclosed in EP1048821A2. A disc portion 50, which is generally symmetrical about a slot axis 31, defines a slot 52 configured to engage a root 54 of an axial compressor blade 56. The root 54 is generally symmetrical about a root axis 55. The slot axis 51 and root axis 55 converge at and normal to the engine central axis 22 on FIG. 1).

The slot 52 comprises a generally radially inwardly facing bearing surface 58 which engages with a complimentary generally radially outwardly facing bearing surface 60 of the root 54. During operation of the engine in a conventional manner, the centrifugal force F of the blade 56 is carried by the disc portion 50. This generates high compressive forces between the bearing surfaces 58, 60. The dimensions of the bearing surfaces 58, 60 are conventionally selected to carry the centrifugal force F.

It should be noted that throughout this specification a "bearing surface" is described with reference to a surface subject to a compressive load imposed from a complimentary surface of a body.

The blade 54 also comprises a neck portion 62 having a minimum width and similarly the disc portion 50 comprises a neck portion 64 having a minimum width. These minimum widths are highly stressed during operation and fillets 68 and 70 are designed to minimise the stress thereat. The original profile 72 (and shown as a dotted line) of the disc slot 52 comprises a shoulder 73 which is smoothly radiused away from the blade root fillet 68. The edge of contact 74 is defined as the point at which the shoulder 73 and blade fillet 68 meet.

The novel feature of EP1048821A2 is a relief groove 76 defined in the shoulder 72 of the disc portion 50. The relief groove 76 is disposed radially outward of the edge of contact 74 and partially defines a lip 78. The lip 78 reduces stiffness of the disc portion 50 at the edge of contact thereby reducing the peak stress concentration thereat. It is stated and shown in FIG. 2 that the relief groove 76 is generally parallel to the bearing surface 58.

Figure 3:
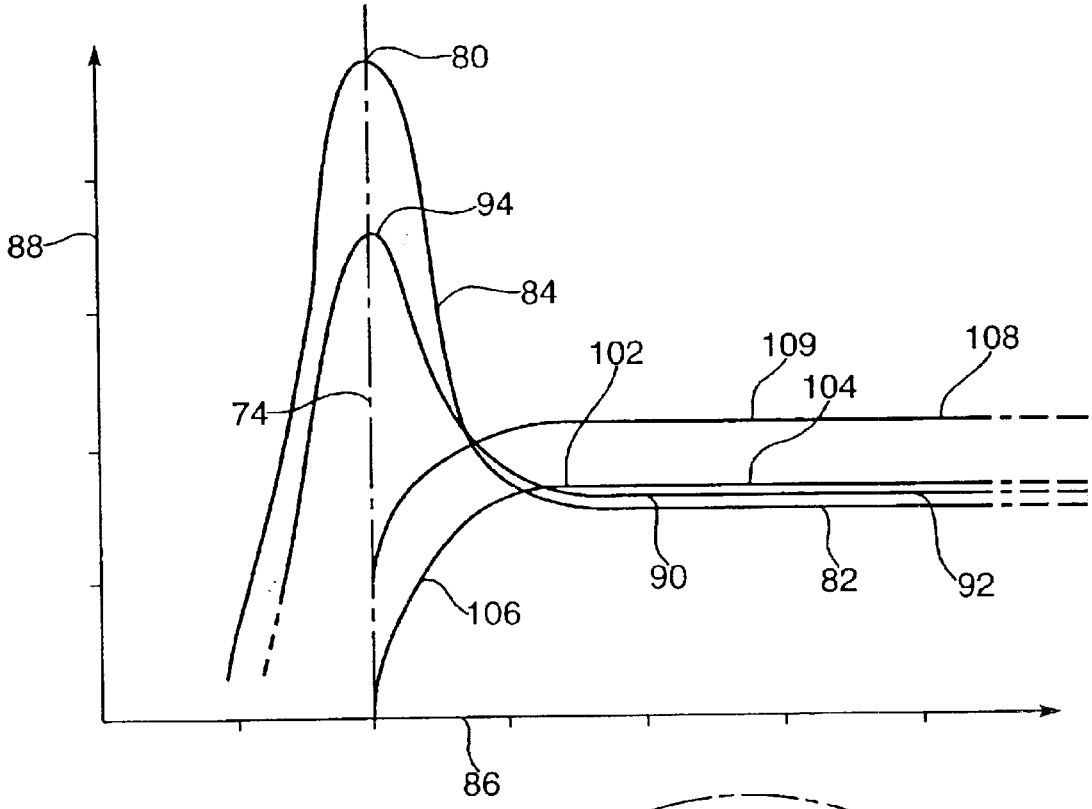
FIG. 3 is a graph of compressive stress along the length of a contacting body bearing surface.

Referring now to FIG. 3, a first line 84 represents the magnitude of compressive stress 88 varying with distance 86 along the bearing surface 60 of the root 54 for the original profile 72 of the shoulder 73. This stress plot has been generated using Finite Element Analysis (FEA) modelling as known in the art. A first portion 82 of the line 84 represents the average bearing stress on the bearing surface 60. On approaching the edge of contact, the location shown by reference numeral 74, the contact stress rises sharply to a first peak stress value 80 which then quickly dissipates to zero as there is no contact beyond the edge of contact 74.

A second line 90 represents the magnitude of compressive stress along the bearing surface 60 of the root 54 for the slot 52 comprising a relief groove 76. The compressive stress is predicted once again by an FEA model of comparable accuracy. A second peak stress concentration 94 still exists although its value is reduced from the first peak stress concentration 80 value generated by the original slot profile 72. As the peak stress 94 is reduced and the total bearing load remains constant, stress is redistributed and manifests itself by an associated increase in the average bearing stress 92. The FEA predicted stress levels are for steady state stresses and it is known that low cycle and high cycle vibrations of a compressor blade 56 in a disc slot 52 exacerbate the peak stress values 80, 94. It is believed that although the peak stress has been reduced by the relief groove 76 the peak stress 94 is still sufficient under certain circumstances for the blade 56 vibrations to cause micro-cracking in the blade root 54.

It is therefore an object of the present invention to reduce the edge of contact 74 stress to below the average bearing stress and preferably to reduce the edge of contact 74 stress to a near zero or zero value.

Figure 4B:
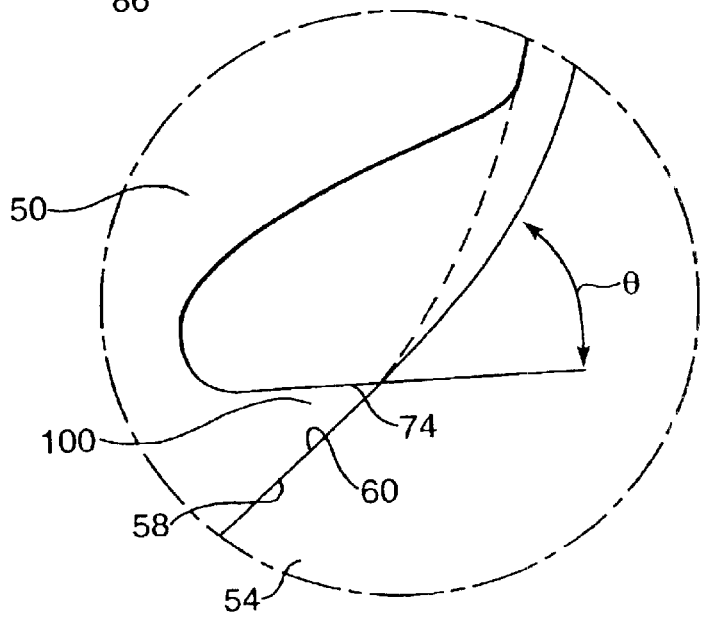
FIG. 4B is an enlargement of an edge of contact region of FIG. 4A.
Figures 4A, 4B:
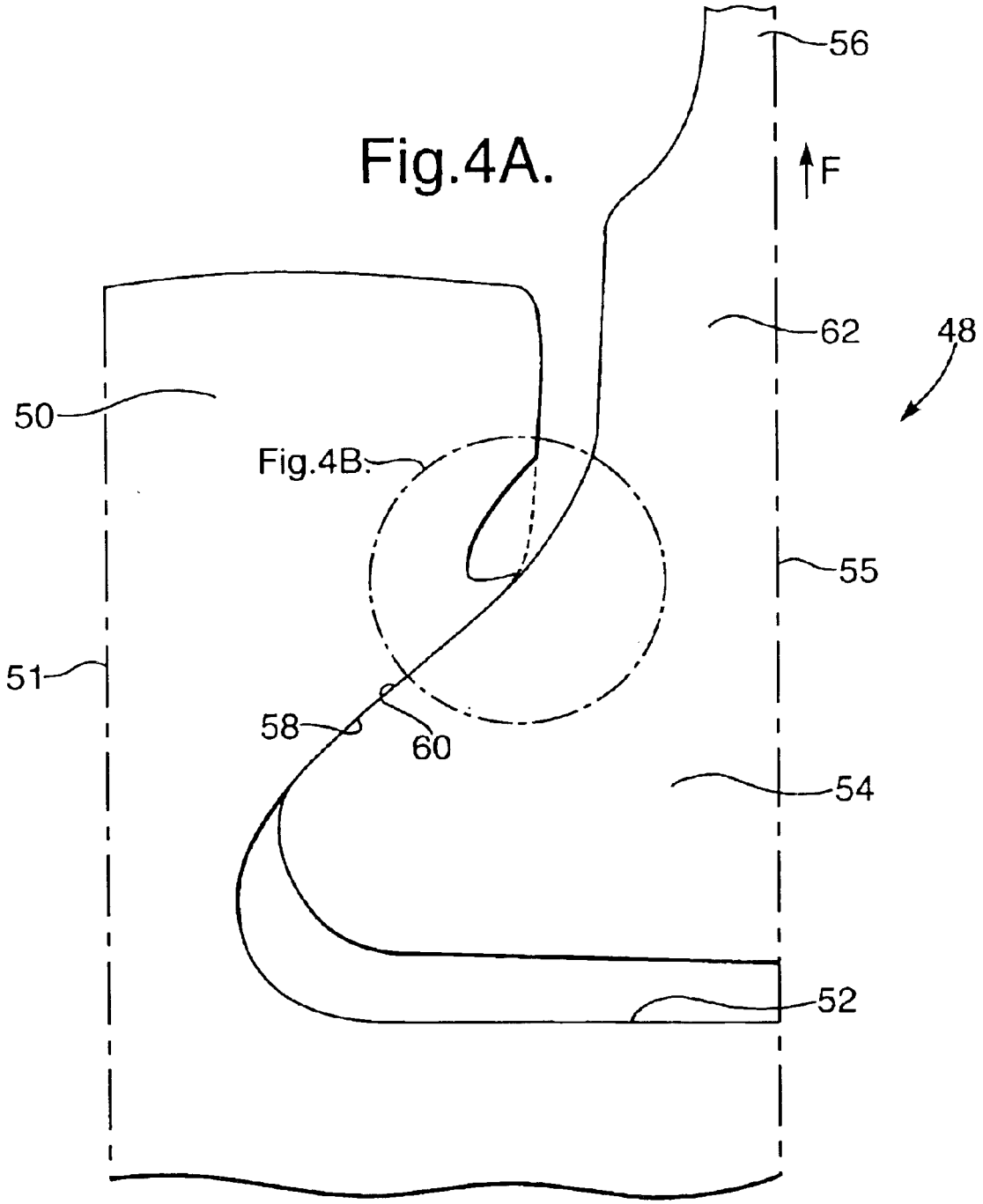
FIG. 4A is a section through a dovetail fixture of the present invention.

Referring to FIGS. 4A and 4B which show an exemplary embodiment of the present invention. Where there are similar elements or features to FIG. 2 the same reference numerals are used. A fan blade 56 having a root 54 is symmetrical about blade root axis 55 and is retained in a disc slot 52 defined by a disc portion 50, which is symmetrical about axis 51. The slot 52 and root 54 are generally arranged as a dovetail fixture 48 as commonly known in the art and comprise bearing surfaces 58 and 60 respectively. These bearing surfaces are angled at 45° to a blade root axis 55. In use the centrifugal force F of the blade 56 is transferred to the disc portion 50 through the bearing surfaces 58, 60. In this embodiment the dovetail fixture 48 is generally axially aligned with the central engine axis 22 and is generally arcuate therein. Alternatively, the dovetail fixture 48 may be straight.

Typically the bearing surfaces 58, 60 areas are designed in accordance with limiting stress criteria of the blade 56 and disc 50 material together with in-service life experience data. Until recently it has not been possible to analyse the value of the peak stress concentration and thus in the past empirical criteria has been used for assessing the influence of the peak stress effects on the bearing surfaces 58, 60. Therefore it has been assumed that an average bearing stress below a certain level will not give rise to an EOC peak stress concentration sufficient to cause micro-cracking. As in-service experience has increased over a number of years and in the quest for ever more economic gas turbine engines the bearing stresses have been increased in accordance with a growing amount of in-service data. However, using modern and highly refined FEA methods to model the stress regime in the dovetail fixture the peak stress concentrations, for original blade and disc geometry, have been identified and are depicted on FIG. 3 as first line 84. Furthermore, laboratory testing and analysis has identified a failure mechanism associated to the EOC peak stress concentrations causing micro-cracking in the blade root 54 at or around the EOC location. Although not sufficient to cause failure of the blade root 54 on it own, the micro-cracking can then be propagated by the high tensile stresses derived from the centrifugal force F of the blade 56. Furthermore the propagation of the micro-cracks is exacerbated by low and high cycle vibrations of the blade 56 during engine operation. Over a long period of time a micro-crack may propagate sufficiently to form a visible crack which if not detected and the blade 56 removed from service can lead to the subsequent release of the part or all of the blade 56.

FIG. 4B shows in more detail the EOC stress relief feature of the present invention. This preferred embodiment comprises a tapering portion 100 generally having an angle θ of 45°, relative to the bearing surfaces 58, 60, although towards the EOC 74 the profile of the tapering portion 100 comprises a continually increasing curvature arranged so that at the point of EOC 74 the profile is normal to the bearing surface 60. The tapering portion 100 is integral to the disc 50 and extends along the entire axial length of the dovetail fixture. The tapering portion 100 reduces only in cross section to its distal edge 74 there being the edge of contact 74 and does not reduce in length along the length of the dovetail fixture.

The profile for the tapering portion 100 may be defined by the following design process: Step 1, calculation of the total centrifugal load F for the worst case load conditions, including for instance the life cycles of the blade and disc; Step 2, determine the maximum allowable pressure on the bearing surfaces; Step 3, calculate the required area of bearing surface for nominal geometry; Step 4, determine the pressure P, shear Q and moment M for a unit width of the bearing surface preferably using FEA or equivalent techniques; Step 5, compare FEA output of step 4 to the maximum allowable pressure on bearing surface and adjust the area accordingly; Step 6, apply a pressure profile to the bearing surface which is generally curved at the ends and linear therebetween and which is equivalent to the applied P, Q and M; Step 7, using complex potential methods (for instance see Muskhelishvili, N. I. (1949) Some basic problems of the Mathematical Theory of Elasticity, $3^{rd}$ Ed, Moscow, English translation by J R M Radok, Noordhoff, 1953), calculate the elastic half space deformation for the pressure profile. From this step an indentor shape is derived whose deformation under the reactive pressure load and which exactly fits the deformation on the elastic half space, thus the shape of the indentor will impose a zero EOC pressure on the worst case loading conditions; Step 8, repeat steps 1–7 for selected sections along the axial length of the blade thereby generating a three dimensional tapering portion 100.

It should be noted that shear Q is a function of the assumed friction (coefficient) between the indentor and the contact body.

Referring again to FIG. 3, a third line 102 represents a comparative FEA predicted compressive stress 88 plot against distance 86 along the blade root 54 bearing surface 60 for the disc slot 52 comprising the tapering portion 100 designed using the above process and as generally shown in FIGS. 4A and 4B. The edge of contact location 74 is shown by dashed line 96 and it can be seen that at the EOC 74 the compressive stress at the EOC is zero. Line 102 comprises an average bearing stress portion 104 and an EOC stress portion 106. The portion 104 is of a greater stress value than the average bearing stress portion 82 because of the redistribution of EOC bearing stress from the peak stress 80 to the EOC stress portion 106. It should be noted that there is a marked contrast at the EOC position 74 between the prior art EOC stress 94 and that of the present invention.

A further advantage of the present invention is now apparent and one that has a surprising and profound effect to the design and capability of dovetail fixtures. As can be seen from FIG. 3 that the tapered portion 100 shown in FIGS. 4A and 4B reduces the EOC 74 stress to below the average bearing stress portion 104. Prior to the conception of the present invention the criteria for an allowable average bearing stress was partly derived from in-service experience data, and limited to a value below which it was known through experience that the resulting EOC peak stress did not cause significant micro-cracking. Thus, by incorporation of the present invention only, it is now possible to substantially increase the allowable average bearing stress between the value of portion 104 and portion 108 of a fourth line 109 representing compressive stress along the bearing surface 60. The design criteria of the dovetail fixture may therefore exclude edge of contact stress concentrations and be based principally on average bearing stress criteria rather than the former empirical criteria.

Figure 5:
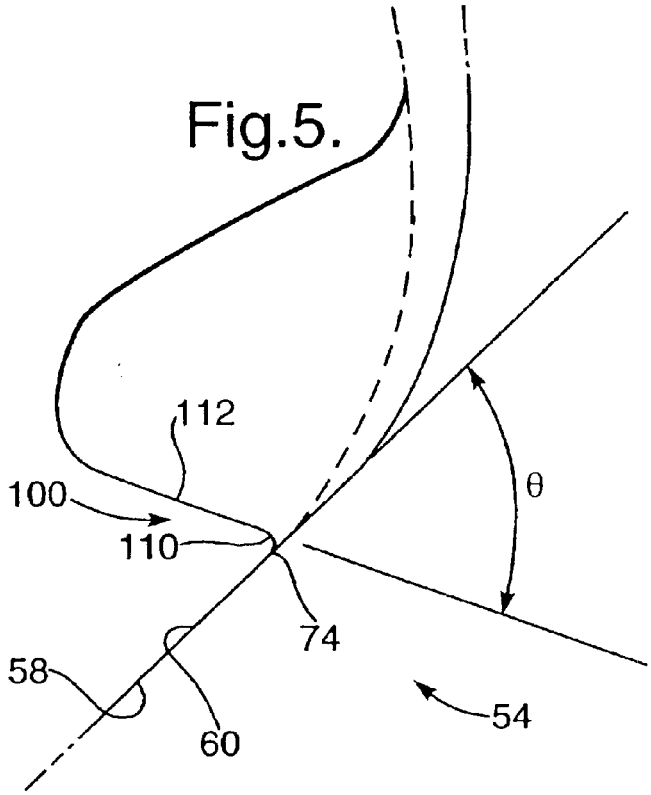
FIG. 5 is an enlargement of the edge of contact region of FIG. 4A showing a further embodiment of the present invention.

Referring now to FIG. 5 which shows a further embodiment of the present invention and where there are similar elements or features to FIG. 4 the same reference numerals are used. In this embodiment the tapering portion 100 comprises its free edge 112 generally angled to the bearing surface 58 at an angle θ=56° and further comprises a radiused apex 110. Although the profile described with reference to FIG. 4B is the preferred and theoretical ideal profile, practical considerations mean that sharp edges such as the edge 74 usually and preferably comprise a small radius. Typically, sharp edges are removed with a radius of 0,3 mm and tolerance of +/−0,2 mm.

Increasing the angle θ to 56° from 45° means that the tapered portion 100 become stiffer and when the engine is operating this increased stiffness can be seen by the profile of a fourth line 114 (see FIG. 7), which represents the compressive stress on the bearing surface 60. The increased stiffness of the tapered portion 100 results in a compressive stress at the EOC 74, shown on FIG. 7, by an EOC stress portion 116 of fourth line 114. However, this EOC stress portion 116 remains below the level of the average bearing stress portion 115. This configuration is particularly beneficial as it increases the average bearing stress portion 115 by a lesser amount than the embodiment of FIG. 4 (the average bearing stress portion 82). Thus when considering a design or redesign of the dovetail feature the average bearing stress may be increased by a greater amount for this embodiment when compared to that described with reference to FIG. 4. From calculations, in accordance with the teachings set out herein, the angle θ=56° is the maximum angle for the tapered portion 100 that does not cause a stress singularity. This stress singularity is where the calculated stress tends towards infinity. In reality where a stress singularity arises very localised plastic deformation occurs and there is a subsequent redistribution of the stress around that location. Although for this embodiment an angle θ=56° is the maximum angle without causing a stress singularity, it is believed that for other configurations and assumptions in the calculation of a suitable angle θ may equal 60°.

Figure 6:
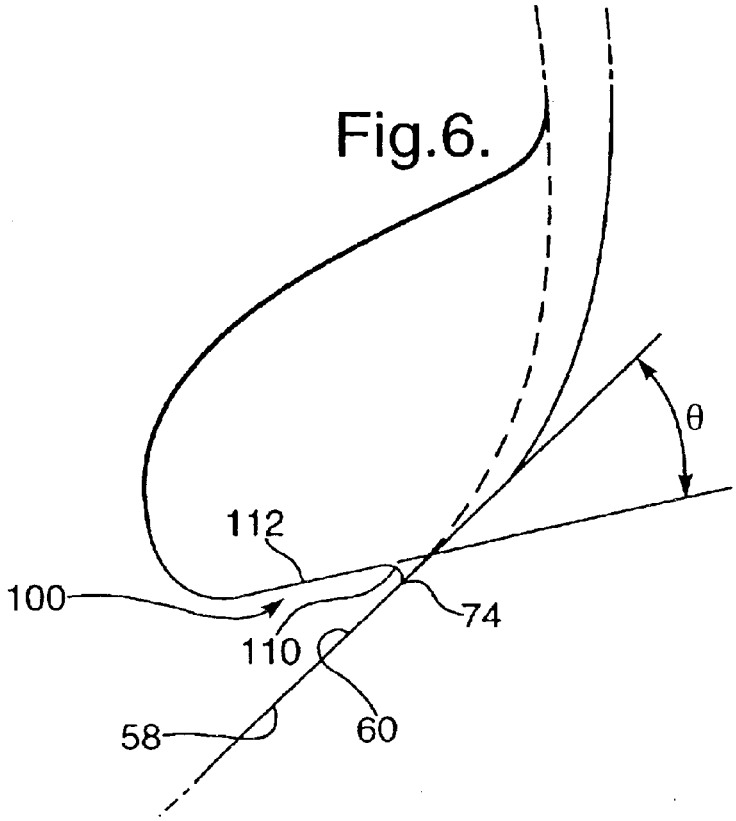
FIG. 6 is an enlargement of the edge of contact region of FIG. 4A showing a further embodiment of the present invention.

Referring now to FIG. 6 which shows a further embodiment of the present invention and where there are similar elements or features to FIG. 4 the same reference numerals are used. In this embodiment the tapering portion 100 comprises its free edge 112 generally angled to the bearing surface 58 at an angle θ=30° and further comprises a radiused apex 110. Although the profile described with reference to FIG. 4B is the preferred and theoretical ideal profile, practical considerations mean that sharp edges such as the edge 74 usually comprise a small radius.

Figure 7:
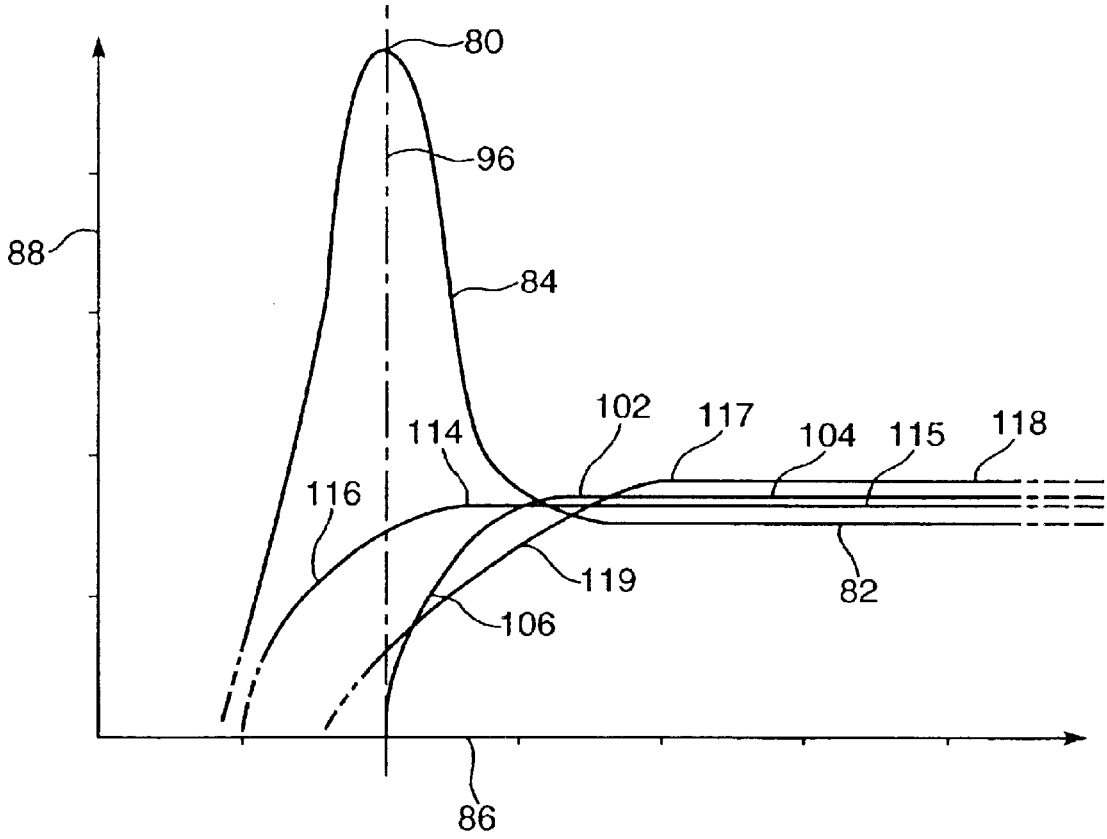
FIG. 7 is a graph of compressive stress along the length of a contacting body bearing surface.

Decreasing the angle θ to 30° from 45 effectively makes the tapered portion 100 more flexible, resulting in an increased redistribution of EOC stresses from the EOC stress portion 119 to the average bearing stress portion 118 on FIG. 7. However the radius 110 at the edge 74 locally stiffens the tapered portion 100 so that an EOC stress portion 119 shows a stress at the EOC location 94. There is a similar effect for the embodiment described with reference to FIG. 5.

It should be noted therefore that the tapered portion 100 is particularly suited to a wedge angle θ between 30 and 60 degrees and preferably an angle θ=45 degrees where a sharp apex is present as shown in FIG. 4. It should be noted that the wedge angle θ will be influenced by the assumed coefficient of friction between the indentor and the contact body. Furthermore, a radiused edge 110 (for example see FIGS. 5 and 6) will influence the wedge angle θ. In certain circumstances it may be preferable to have a wedge angle greater than 45 degrees so that the tapered portion 100 is more robust.

Figure 8:
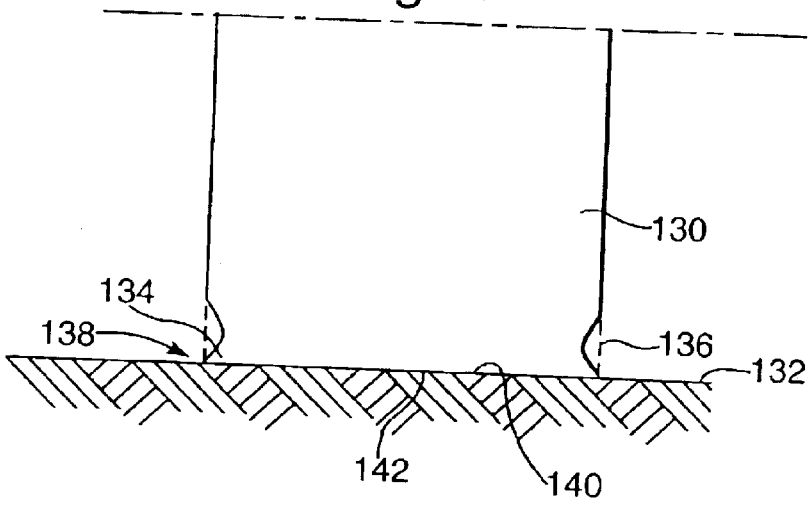
FIG. 8 is a section though part of a rolling element of a roller bearing incorporating the present invention.

Referring to FIG. 8 a rolling element 130 of a roller bearing (not shown) comprises a tapering portion 134 in accordance with the present invention. In use the roller bearing 130 (or indentor) contacts a surface 140 of a body, for instance a bearing race. Without the incorporation of the tapering portion 134 and as shown by the dashed lines 136 the bearing stress along the surface 132 (between the centre of a contact surface 142 of the indentor to an edge of contact 138) comprises a similar profile to the line 84 of FIG. 7. However, the inclusion of the tapering portion 134 reduces the edge of contact 138 stress concentration to a stress level below the near uniform stress on the surface 140 of the body 132.

Figure 9:
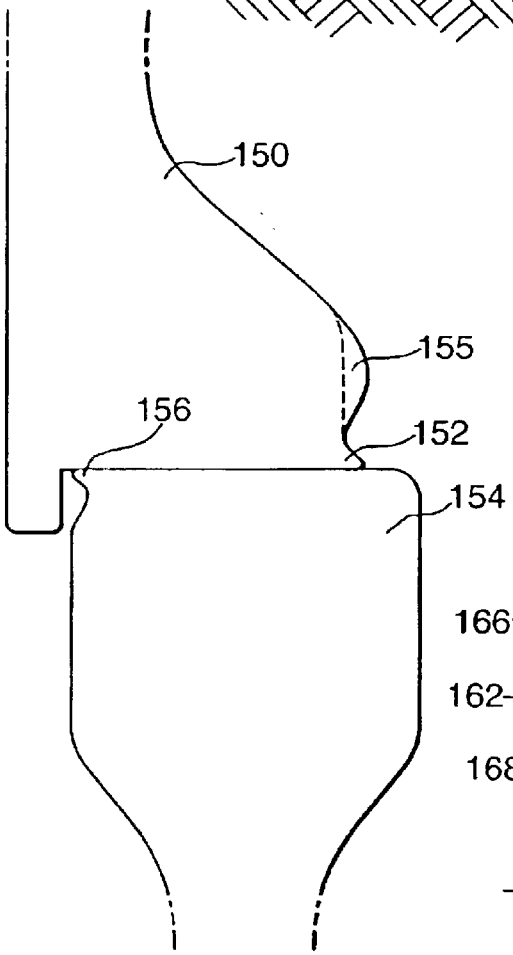
FIG. 9 is a section through a portion of a railway wheel and track incorporating the present invention.

Referring to FIG. 9, a tapered portion 152 in accordance with the present invention may also be incorporated into the design of a railway wheel 150 and similarly the track 154 may incorporate a tapered portion 156. The railway wheel 152 and the track 154 behave as an indentor at their respective edge of contacts where the tapered portions 152, 156 are located. Where the tapered portion 152 is incorporated as a remedial measure the region 155 may remain as shown by the solid outline or removed as shown by the dashed line. The performance of the tapering portion 152 is not significantly affected by either solid or dashed profiles.

Although the surfaces of the contact bodies (the bearing race 132, track 154 and railway wheel 150) in FIGS. 8 and 9 are not subject to micro-crack propagating tensile stresses the high cyclic nature of loading are known to cause fatigue at and around the EOC location on the contacting surface. Thus for these applications removing the EOC peak stress concentration is equally important in extending the life of the contact bodies 132, 154, 150. It should be noted that the tapering portion 134, 152 and 156 shown on FIGS. 8 and 9 are annular.

Figure 10:
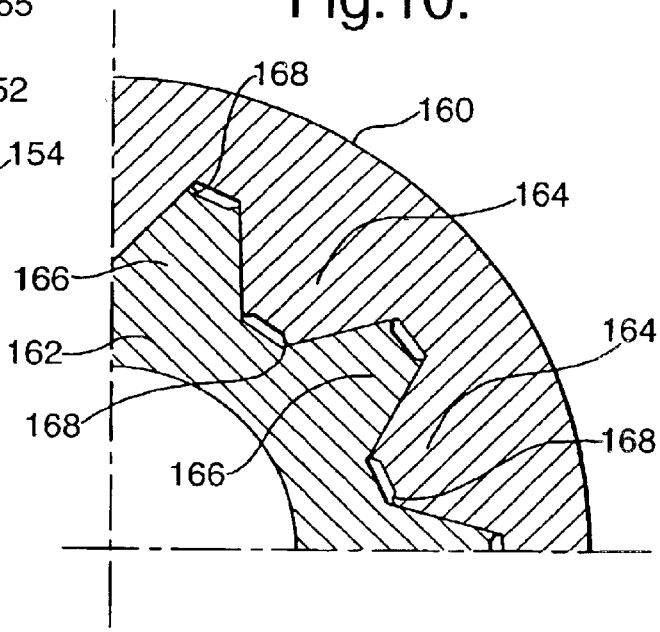
FIG. 10 is a section through a portion of two interconnected shafts incorporating an embodiment of the present invention.

Referring to FIG. 10, two coaxial shafts 160, 162 are interconnected via interlocking teeth 164, 166, which in use engage one another imparting rotational forces therebetween. Each tooth 164, 166 extends radially inwardly or outwardly from its respective shaft 160, 162 and comprises at its distal end a tapered portion 168. It should be understood to the skilled reader that the distal end of each tooth 164, 166 acts as an indentor and the corresponding tooth 164, 166 the contacting surface which, but for the incorporation of the present invention, incur an EOC peak stress concentration. As the shafts 160, 162 may be driven clockwise and anti-clockwise a tapered portion 168 is disposed to both sides of the distal end of the teeth 164, 166.

Figure 11:
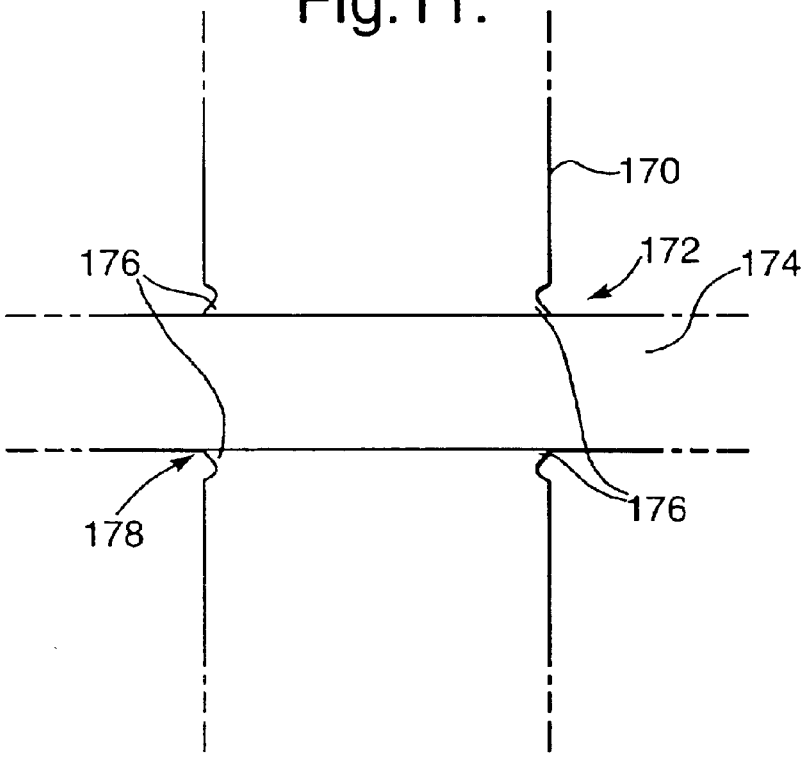
FIG. 11 is a cross section through a wall and pin arrangement incorporating an embodiment of the present invention.

Referring to FIG. 11, a further embodiment incorporating the present invention comprises a wall 170, which defines a hole 172 through which a pin 174 passes. The wall 170 further comprises a tapered portion 176, in accordance with the present invention as described hereinbefore, disposed at an edge of contact 178 between the wall 170 and the pin 174. In this embodiment the wall 170 is the indentor and the pin is the complimentary contact surface. In use the pin 174 does not move or rotate relative to the wall 170. It is intended that the tapered portions 176 reduce the edge of contact peak stress distribution in the pin 174 during an applied load, in a direction generally in the plane parallel to the wall 170, between the pin 174 and the wall 170. This embodiment of the present invention may be used to replace or modify existing similar arrangements.

Figure 12:
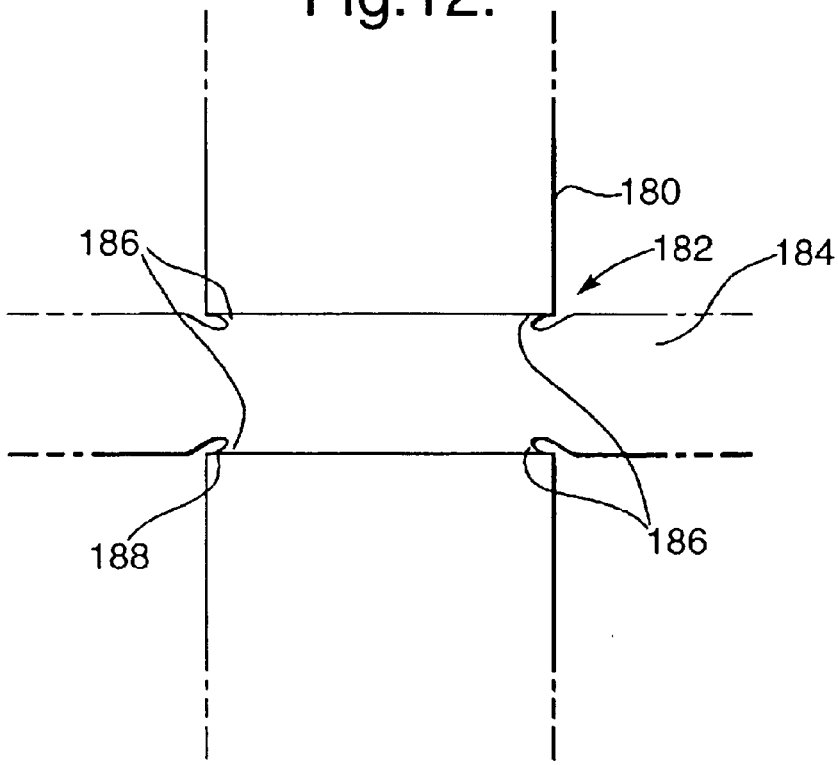
FIG. 12 is a cross section through a plate and pin arrangement incorporating an embodiment of the present invention.

Referring now to FIG. 12 a further embodiment incorporating the present invention comprises a plate 180, which defines a hole 182 through which a pin 184 passes. The pin 180 further comprises a tapered portion 186, in accordance with the present invention as described hereinbefore, disposed at an edge of contact 188 between the plate 180 and the pin 184. In this embodiment the pin 184 is the indentor and the plate 180 is the complimentary contact surface. In use the pin 184 does not move or rotate relative to the plate 180. It is intended that the tapered portions 186 reduce the edge of contact peak stress distribution in the plate 180 during an applied load, in a direction generally in the plane parallel to the plate 180, between the pin 184 and the plate 180.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface.

2. An indentor as claimed in claim 1 wherein, in use, the contact surface and the bearing surface generate a near uniform compressive stress field in the bearing surface and the edge of contact generates a non-uniform stress field in the bearing surface, the tapered portion is shaped so that the edge of contact non-uniform stress is a lower value than the near uniform stress.

3. An indentor as claimed in claim 1 wherein the tapered portion comprises a taper angle, the taper angle is between 30 and 60 degrees.

4. An indentor as claimed in claim 1 wherein the tapering portion comprises an apex and the apex comprises a radius. 30 and 60 degrees.

5. An indentor as claimed in claim 1 wherein said tapering portion has a free surface and a fillet radius is defined between the free surface and the indentor.

6. An indentor as claimed in claim 1 wherein the indentor is a disc portion and the bearing surface is a blade root of a gas turbine engine.

7. An indentor as claimed in claim 1 wherein the indentor is a blade root and the bearing surface is a disc portion of a gas turbine engine.

8. An indentor as claimed in claim 1 wherein the tapering portion extends substantially the length or circumference of the indentor.

9. A gas turbine engine comprising an indentor as claimed in claim 1.

10. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein, in use, the indentor's contact surface and the bearing surface generate a near uniform compressive stress field in the bearing surface and the edge of contact generates a non-uniform stress field in the bearing surface, the tapered portion is shaped so that the edge of contact non-uniform stress is approximately zero.

11. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the tapered portion comprises a taper angle, the taper angle is 45 degrees.

12. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the tapered portion comprises a free surface, the free surface comprising a convex shape.

13. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the tapered portion comprises a free surface, the free surface comprising a convex shape wherein the convex shape being defined by a curve having a decreasing rate of change of curvature from and between the distal edge of the tapered portion which is aligned normal to the bearing surface and the base which is aligned at the taper angle.

14. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the indentor is a rolling element of a bearing assembly.

15. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the indentor is any one of a group comprising a railway wheel and a railway track.

16. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the indentor is a tooth.

17. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the indentor comprises a wall and a pin, the wall defining an aperture through which the pin extends, the wall further defining a tapered portion at an edge of contact with the pin.

18. An indentor for contacting a bearing surface, the indentor comprising a contact surface complimentary to that of the bearing surface, wherein the indentor comprises an integral tapering portion which tapering portion defines part of the contact surface, the tapering portion at its distal edge defining an edge of contact between the contact surface and the bearing surface wherein the indentor comprises a plate and a pin, the wall defining an aperture through which the pin extends, the pin further defining a tapered portion at an edge of contact with the pin.

* * * * *